US005252424A

United States Patent [19]

Sato et al.

[11] Patent Number: 5,252,424

[45] Date of Patent: Oct. 12, 1993

[54] PHOTOGRAPHIC PAPER

[75] Inventors: Erika M. Sato, Rochester, N.Y.; Peter D. Marsden, North Harrow, England

[73] Assignee: Eastman Kodak Company, Rochester, N.Y.

[21] Appl. No.: 941,333

[22] Filed: Sep. 4, 1992

[51] Int. Cl.[5] ..... G03C 1/52

[52] U.S. Cl. ..... 430/138; 430/510; 430/538; 430/523

[58] Field of Search ..... 430/538, 138, 510, 523, 430/531

[56] References Cited

U.S. PATENT DOCUMENTS

| | | | |
|---|---|---|---|
| 3,091,535 | 5/1963 | Milner, Jr. . | |
| 3,340,062 | 9/1967 | Hunter, Jr. et al. . | |
| 3,758,376 | 9/1973 | Beckner et al. . | |
| 3,833,368 | 9/1974 | Land et al. . | |
| 3,833,369 | 9/1974 | Chiklis et al. . | |
| 4,088,487 | 5/1978 | Bloom et al. . | |
| 4,272,594 | 6/1981 | George et al. . | |
| 4,407,939 | 10/1983 | Naoi et al. | 430/538 |
| 4,477,562 | 10/1984 | Zeller-Pendrey . | |
| 4,548,898 | 10/1985 | Yamada et al. . | |
| 4,563,406 | 1/1986 | Ohbayashi et al. . | |
| 4,665,013 | 5/1987 | Sack et al. | 430/538 |
| 4,678,742 | 7/1987 | Tamagawa et al. | 430/538 |
| 4,752,559 | 1/1988 | Helland et al. . | |
| 4,755,454 | 7/1988 | Aotsuka et al. | 430/538 |
| 4,794,071 | 12/1988 | Tomko et al. | 430/538 |
| 4,801,509 | 1/1989 | Uno et al. | 430/538 |
| 4,921,781 | 5/1990 | Takamuki et al. . | |

FOREIGN PATENT DOCUMENTS

| | | |
|---|---|---|
| 0337490 | 10/1989 | European Pat. Off. . |
| 906330 | 9/1962 | United Kingdom . |

*Primary Examiner*—Jack P. Brammer
*Attorney, Agent, or Firm*—Paul A. Leipold

[57] ABSTRACT

The invention provides a photographic element comprising a paper substrate with a polyolefin coating provided on at least one surface, a hydrophilic colloid layer on the polyolefin coating, and at least one light sensitive silver halide emulsion above the hydrophilic colloid layer, wherein said hydrophilic colloid layer comprises a removable antihalation material and from about 20 to 80 percent by weight of a white pigment, and from about 15 to 35 percent by weight of hollow microspheres having a diameter of from about 0.1 to about 1 μm.

15 Claims, No Drawings

PHOTOGRAPHIC PAPER

FIELD OF THE INVENTION

This invention relates to photographic paper and more particularly to photographic paper that exhibits improved opacity, reflectance, and image sharpness characteristics.

BACKGROUND OF THE INVENTION

It has been heretofore known to apply polyolefin layers to both surfaces of paper prepared for photographic purposes. In many cases, the polyolefin layer which is between the paper support and the light sensitive photographic emulsion has pigments added thereto, such as titanium dioxide in order to render the polyolefin layer white in appearance. This also increases the reflectivity of the polyolefin surface and improves the quality of the resulting photograph. A problem that exists with such substrates employed in the photographic art is that the sharpness of the resulting image formed in the light sensitive layers is not as high as is desirable when very high quality images are needed, for example, in professional applications. This is generally true because it is not possible to include sufficiently high percentages of pigment material in the polyolefin coatings to achieve the opacity and reflectivity necessary for high sharpness quality images.

In order to overcome this problem, the prior art suggests that a layer of gelatin containing titanium dioxide particles be interposed between one of the polyolefin layers and the light sensitive photographic emulsion. British Patent Specification No. 1,551,258 suggests a photographic paper coated on both sides with polyethylene and coated on one polyethylene surface with a mixture of gelatin, colloidal silica, and particles of titanium dioxide, baryta or (non-colloidal) silica having an average particle size within the range of 0.1 to 5 microns and optionally an anionic surface active agent.

U.S. Pat. No. 4,558,002, issued Dec. 10, 1985, teaches a photographic paper having such a structure wherein the layer intermediate to the polyolefin layer and the light sensitive layer is a hydrophilic colloid layer containing a dye or pigment that is not decolored during photographic processing and a white pigment present in the hydrophilic colloid layer in an amount not less than 30% by volume.

U.S. Pat. No. 4,755,454 suggests a structure similar to the two preceding discussed references wherein the hydrophilic colloid layer contains a white pigment present in an amount of at least 68 percent by weight.

In order to improve sharpness in color paper, it is possible to place a reflective layer between the emulsion and RC layer. However, a significant degradation of the sharpness can still be caused by the backscatter of light from the reflective layer. To minimize this backscatter, it is possible to put an antihalation layer between the reflective layer and the silver halide emulsion layer or to add an absorber dye into the emulsion layer.

However, while this improves sharpness, it is at the cost of a great loss in sensitivity. It is also possible to coat an antihalation layer below the reflective layer (U.S. Pat. No. 4,563,406; EP 337 490). This method provides improved sharpness without such a significant loss in speed. However, this method requires that two extra layers be coated onto the paper support.

PROBLEM TO BE SOLVED BY THE INVENTION

There is a need for color photographic paper with improved sharpness, opacity, and reflective properties.

SUMMARY OF THE INVENTION

The invention provides a photographic element comprising a paper substrate with a polyolefin coating provided on at least one surface, a hydrophilic colloid layer on the polyolefin coating, and at least one light sensitive silver halide emulsion above the hydrophilic colloid layer, wherein said hydrophilic colloid layer comprises a removable antihalation material and about 20 to 85 percent by weight white pigment In a preferred embodiment of the invention, the hydrophilic colloid layer comprises a removable antihalation material and from about 20 to 80 percent by weight of a white pigment, and from about 15 to 35 percent by weight of hollow microspheres having a diameter of from about 0.1 to about 1 μm. It is preferred that the hydrophilic colloid layer contain an optical brightener.

ADVANTAGEOUS EFFECT OF THE INVENTION

The invention provides a polyolefin coated photographic paper having improved sharpness wherein on the free surface of a polyolefin layer a hydrophilic colloid layer containing removable antihalation material and white pigment is coated. The combination of white pigment and removable antihalation material provides the advantage of improved whiteness and effective antihalation all in one layer. The preferred hydrophilic colloid layer contains antihalation material, from about 20 to about 80 percent by weight of a white pigment and from about 5 to about 35 percent by weight of hollow microspheres having a mean diameter of from about 0.2 to about 2 μm.

DETAILED DESCRIPTION OF THE INVENTION

Any suitable white pigment may be used, such as, for example, barium sulfate, zinc oxide, barium stearate, silver flakes, silicates, alumina, calcium carbonate, antimony trioxide, zirconium oxide, zirconium acetyl acetate, sodium zirconium sulfate, kaolin, mica, titanium dioxide and the like. The anatase and rutile crystalline forms of titanium dioxide are preferred. The anatase form is most preferred because of its whiteness. The white pigment should preferably have an average particle size of from about 0.1 to about 1.0 μm and most preferably from about 0.2 to about 0.5 μm. The improved sharpness without significant loss of speed is possible with the removable antihalation material in the hydrophilic layer. The removable antihalation materials surprisingly improve sharpness without losing speed.

As indicated above, the preferred hydrophilic colloid layer also contains from about 5 to about 35 percent by weight of hollow microspheres having a mean diameter less than 2 micrometers preferably from about 0.1 to about 1 micrometer and most preferably from about 0.25 to about 0.8 micrometer. The microspheres are hollow or air-containing microcapsular particles having polymeric walls. Any suitable polymeric material may be employed, such as, for example, polyvinyl chloride, polystyrene, polyvinyl acetate, vinyl chloride-vinylidene chloride copolymers, cellulose acetate, ethyl cellulose, novalac resins having a linear polymeric configuration, acrylic resins, such as for example, polymethylmethacrylate, polyacrylamide, and the like, copolymers of any suitable combination of ethylenically unsaturated monomers including those specifically mentioned above, and the like. Particularly suitable microspheres for use in accordance with this invention are those formed from a copolymer of styrene and acrylic acid and sold by Rohm and Haas Company under the trade designation ROPAQUE OP-42, OP-62 and OP-84. The hollow microcapsules taught in U.S. Pat. Nos. 3,418,250; 3,418,656; 3,585,149; and 3,669,899, all of which are fully incorporated herein by reference are applicable for use in accordance with this invention.

Any suitable hydrophilic colloid may be employed in the practice of this invention such as, for example, both naturally occurring substances, such as, proteins, derivatives thereof, cellulose derivatives, such as, cellulose esters, gelatin including alkali treated gelatin or acid treated gelatin, gelatin derivatives, and any of the hydrophilic materials described in *Research Disclosure* 308119, paragraph IX, published December, 1989. A mixture of any of these materials may also be used if desired. Preferably the hydrophilic colloid is deionized gelatin which may be acid or alkali processed. The hydrophilic colloid material is employed as a binder for the various ingredients in an amount of from about 5 to about 50 percent by weight based on the total weight of the layer, preferably from about 8 to about 35 percent and most preferably from about 10 to about 25 percent.

In addition to the white pigment and the removable antihalation material, the hydrophilic colloid layer may contain additional addenda in order to optimize the appearance and reflectivity of the layer and the photographic print when utilized in accordance with this invention, such as, for example, optical brighteners, UV absorbers, various coloring agents, such as dyes or pigments as disclosed in U.S. Pat. No. 4,558,002 (incorporated herein by reference).

Typically optical brighteners are utilized to improve the whiteness of the white areas of a color print. Suitable optical brightening agents such as, thiophenes, stilbenes, triazines, imidozolones, pyrazolines, triazoles, coumarins, oxazoles, oxadiazoles, acetylenes, vinylenes, and the like as set forth in *Research Disclosure,* Volume 308, December, 1989, page 998, paragraph V, and U.S. Pat. No. 4,794,071 (both fully incorporated herein by reference). Particularly preferred optical brightening agents are hydrophobic brighteners incorporated into the hydrophilic colloid layer in the form of a loaded latex as taught in U.S. Pat. Nos. 4,203,716 and 4,584,255. The optical brightening agent may be imbided onto the hollow microspheres and incorporated into the hydrophilic colloid in this matter rather than employing a separate latex unto which the optical brightener is loaded.

Suitable biocides include, for example, phenol, thymol, polychlorphenols, cresol, p-chlorocresol, benzylphenol, halophens, 2,2'-dihydroxy-5,5'-dichlorodiphenyl, sorbic acid, amines, such as, hexamethyltetramine, disulfides, mercapto compounds, imidazols, mercury compound antibiotics, benzoisothiazole, isothiazolinones and other materials set forth in U.S. Pat. Nos. 4,224,403 and 4,490,462, both of which are incorporated herein by reference.

Suitable ultraviolet absorbers include aryl substituted benzotriazole compounds, 4-thiazolidone compounds, benzophenone compounds, cinnamic acid ester compounds, butadiene compounds, benzooxazole compounds and other UV absorbers as set forth in *Research Disclosure,* Vol. 308, December 1989, page 1003, paragraph VIII (incorporated herein by reference).

The various ingredients to be employed in the hydrophilic colloid layer in accordance with this invention are formulated into a suitable coating composition for the deposition of the layer by any suitable technique. In addition to the various ingredients, dispersing aids are employed in order to obtain suitable and uniform distribution of the white pigment and hollow microspheres throughout the layer. Suitable dispersing aids include those set forth, for example, in U.S. Pat. Nos. 3,288,846; 3,298,956; 3,214,454; 3,234,124; 3,567,768; and 3,796,749.

In a preferred method of preparing the coating composition for forming the hydrophilic colloid layer the white pigment, dispersing agents and biocide if one is to be used, are intimately mixed in water in a media mill, Cowles dissolver, or other suitable high shear apparatus. This pigment dispersion is next mixed with the remainder of the components including the antifoggant, the microspheres, the optical brightener tinting aids, and the like, and then added to the gelatin which has been previously melted.

The dispersing aid or aids are generally present in an amount of from about 0.05 to 2 and preferably from about 0.05 to about 0.5 percent by weight based on the dry ingredients present. The coating composition is then applied by any suitable coating technique on appropriate coating equipment to the surface of the polyolefin layer which has been coated onto the surface of the raw paper stock in accordance with the commonly accepted practice in the photographic paper industry. The paper stock generally and preferably contains layers of polyolefin on both sides of the paper stock. In many instances, different types of polyolefin will be applied to either surface in order to aid in curl control of the paper.

After application of the polyolefin to the paper stock, the surface of the polyolefin layer, which is to receive the hydrophilic colloid layer with antihalation materials, and ultimately the light sensitive layer or layers, is treated with a corona discharge in order to improve the adhesion of subsequent layers. The various layers that form the structure in accordance with this invention may have interposed therebetween subbing layers, widely known in the art, to also improve adhesion between adjacent layers. Onto the corona discharge treated surface of the polyethylene is deposited a hydrophilic colloid layer in accordance with this invention. A particularly suitable coating composition for deposition of the hydrophilic colloid layer includes a water dispersion of about 10 to 20 parts by weight of anatase titanium dioxide, a particularly preferred material being a product sold under the trade designation UNITANE 0-310 by Kemira Inc., Savanna, Ga., about 0.015 to about 0.045 of a suitable dispersing aid to uniformly aid in the distribution of the solid particles in the dispersion, a particularly useful dispersing aid is a mixture of sodium salt of a polycarboxylic acid sold under the trade designation DISPEX N-40 by Allied Colloids and tetrasodium pyrophosphate, which is sold under the trade designation TSPP by FMC; about 0.001 to about 0.0025 parts of a suitable biostatic agent, a particularly suitable material is one sold under the trade designation Ottasept by Ferro Corp. from about 3 to about 5 parts by weight of gelatin, from about 6.5 to about 8 parts of hollow microspheres a particularly suitable material is one sold under the trade designation ROPAQUE OP-84 by the Rohm & Haas Company; from about 0.04 to about 0.07 parts of an optical brightener, a particularly suitable material is one sold under the trade designation UVITEX-OB by CibaGeigy and having the formula:

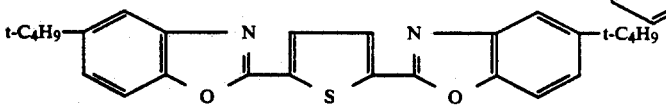

about 0.001 to about 0.003 parts of a combination of cyan and magenta tinting pigments sold under the trade designation TINT-AYD WD-2018 by Daniel Products Company and the balance of water in order to make 100 parts by weight of coating composition. With regard to the optical brightening agent, it is preferred that this material be added to the dispersion in the form of a loaded latex by being incorporated into the latex in accordance with U.S. Pat. Nos. 4,203,716 or 4,584,255, both incorporated herein by reference. In this regard, the latex is one prepared by an emulsion polymerization technique wherein styrene and divinyl benzene are copolymerized. The latex is employed in an amount from about 2.5 to about 3.5 parts in the formulation set forth. This composition is coated onto the corona discharge treated polyolefin surface in a coverage of at least about 500 milligrams/ft$^2$ (5.4 g/m$^2$) preferably from about 500 mg/ft$^2$ and to about 1500 mg/ft$^2$ (16.2 g/m$^2$), and most preferably from about 700 mg/ft$^2$ (7.5g/m$^2$) to about 1000 mg/ft$^2$ (10.9 g/m$^2$).

The antihalation materials suitable for use in the hydrophilic colloid layer may be any suitable antihalation material that is removable or may be rendered colorless during the development process. Typical of such materials are filter dyes and yellow, blue, or gray colloidal silver. It is possible to use a material capable of absorbing light in the entire visible region or only a part of the region. The preferred material is colloidal silver, as it is low in cost and easily removable during development. The amount of colloidal silver or other antihalation used is sufficient to absorb enough scattered light to increase of sharpness of the paper without absorbing so much as to decrease significantly the sensitivity of the paper. If not enough antihalation material is utilized, no significant increase in sharpness is obtained.

Typical of antihalation dyes that are suitable are filter dyes, such as acidic dye having sulfonyl groups or carboxyl groups in the molecules, as exemplified by azo type, triphenylmethane type, anthraquinone type, styryl type, benzylidene type, melocyanine type, oxonol type, and other acidic dyes.

Such dyes are disclosed in the respective specifications of Japanese Patent Publication Nos. 22069/1964, 13168/1968, 42667/1971, 42668/1971, 6207/1974, 10058/1980, 10061/1980, 10059/1980, 10060/1980, and 100187/1980, Japanese Provisional Patent Publication Nos. 117123/1977 and 128125/1977. More specifically, the following compounds may be mentioned.

(F-1)

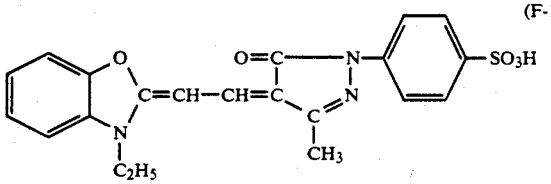

-continued (F-2)

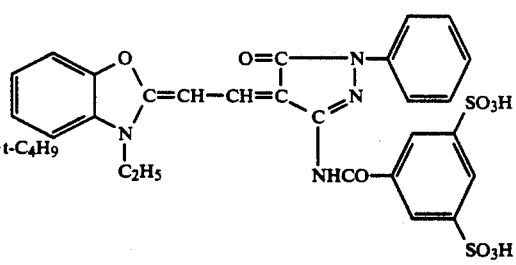

(F-3)

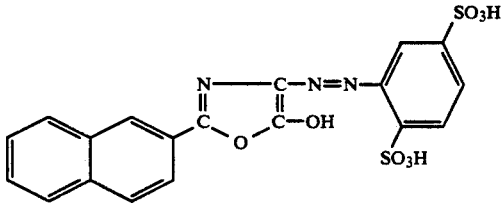

(F-4)

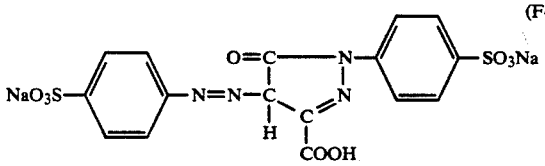

(F-5)

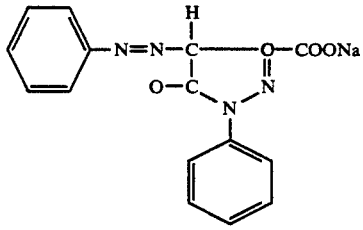

(F-6)

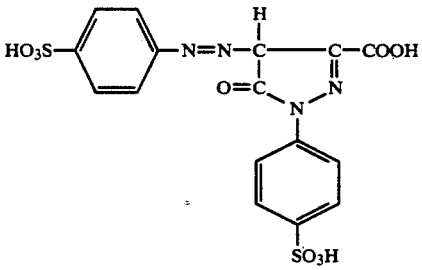

(F-7)

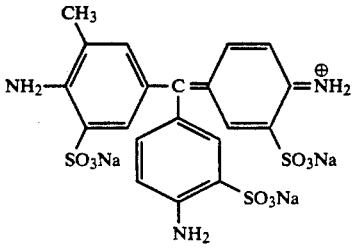

-continued (F-8)

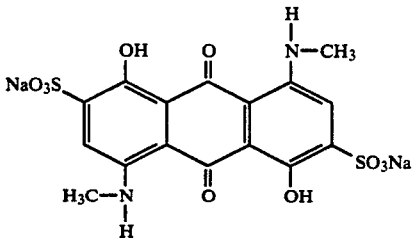

(F-9)

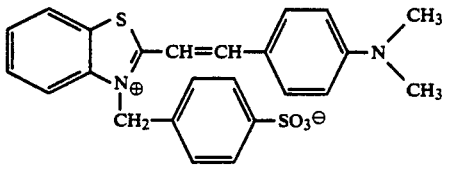

(F-10)

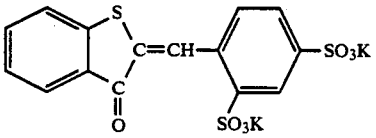

(F-11)

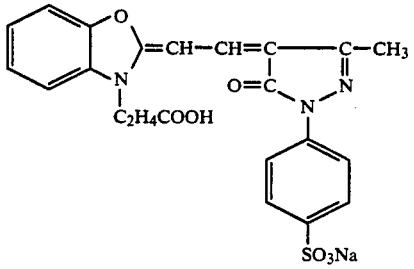

(F-12)

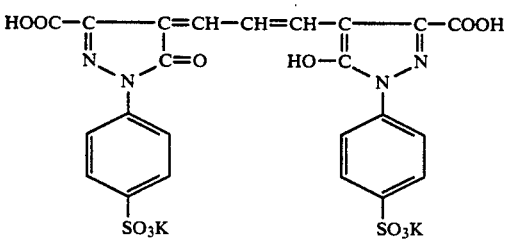

(F-13)

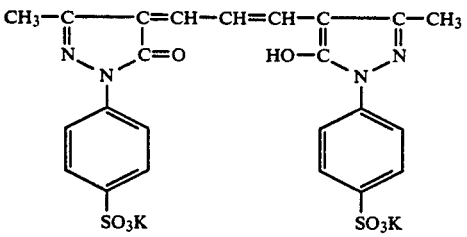

(F-14)

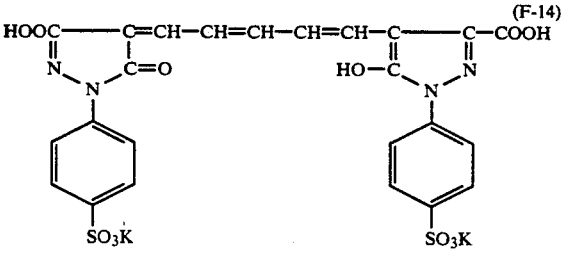

-continued (F-15)

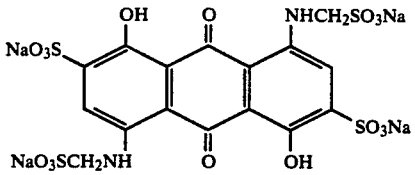

These antihalation filter dyes may be used either singly or in combination with other filter dyes or yellow, gray, and blue colloidal silver.

When yellow, gray, and blue colloidal silvers are used, these colloidal silvers are generally removed in the step of bleaching or fixing (or bleach-fixing), and the filter dye is dissolved out from the lightsensitive silver halide photographic material in any of the steps of developing, bleaching, fixing (or bleach-fixing, or washing with water) or decolored with a sulfite as disclosed in U.K. Patent 506,386. Gray colloidal silver is the preferred antihalation material, as it is effective and easily removed.

The antihalation materials of the invention are incorporated into the hydrophilic colloid layer. Adding them to the hydrophilic colloid layer, simplifies coating formation of the photographic element.

Finally, at least one silver halide emulsion layer is built on the free surface of the hydrophilic colloid layer or the layer containing removable antihalation material. Any of the known silver halide emulsion layers, such as those described in *Research Disclosure,* Volume 176, December 1978, Item 17643 and *Research Disclosure,* Volume 225, January 1983, Item 22534, the disclosures of which are hereby incorporated by reference in their entirety, are useful in preparing photographic elements in accordance with this invention. Generally, the photographic element is prepared by coating the support with one or more layers comprising a dispersion of silver halide crystals in an aqueous solution of gelatin, and optionally one or more subbing layers, etc. The coating process is generally carried out on a continuously operating machine wherein a single layer or a plurality of layers are applied to the support. For multi-layer elements, layers are generally coated simultaneously on the support as described in U.S. Pat. Nos. 2,761,791 and 3,508,947.

The invention will be further illustrated by the following examples:

EXAMPLES 1 AND 2

A high quality paper substrate having a thickness of 178μm and a basis weight of 185 g/m$^2$ was laminated on one surface with clear medium density polyethylene in a thickness of 30 μm (29 g/m$^2$) and on the opposite surface with a low density polyethylene containing 12.5% TiO2 and 0.05% of a mixture of bis(benzoxyazolyl) stilbene optical brighteners described in U.S. Pat. No. 4,794,071 in a thickness of 28 μm (27 g/m$^2$) to prepare a support. The medium density polyethylene resin coat was subjected to a corona-discharge treatment and coated with an antistat in the amount of 0.17–0.47 g/m$^2$ dry weight.

An aqueous white pigment containing formula having a composition as described in Table I was prepared in the following manner:

TABLE I

| Hydrophilic Colloid Coating Formula | | |
|---|---|---|
| Ingredient | Dry Wt (Kg) | Wet Wt (Kg) |
| 1 $TiO_2$ dispersion | 14.39 | 20.56 |
| 2 Distilled Water | — | 12.27 |
| 3 Optical Brightener[a] | 3.14 | 9.84 |
| 4 Ropaque OP-84[b] | 7.2 | 17.99 |
| 5 Tint Ayd WD 2018[c] | 0.0019 | 0.086 |
| 6 Gelatin[d] | 3.93 | 39.25 |

[a]Uvitex loaded styrene/divinyl benzene latex described in U.S. Pat. No. 4,584,255
[b]Styrene/acrylic polymer, sold by Rohm and Haas Co.
[c]Light fast cyan and magenta pigment dispersion, sold by Daniel Products Co.
[d]Deionized hide gelatin

PREPARATION OF TiO2 DISPERSION

To 39.47 Kg of distilled water was added with stirring 0.108 Kg of tetrasodium pyrophosphate, 0.33 Kg of a 40% solution of Dispex N-40 (manufactured by Allied Colloids and 0.341 Kg of a 3.5% solution of 4-chloro-3.5 dimethyl phenol, a biocide, sold under the trade designation Ottasept by Ferro Corp. After 5 minutes of mixing 119.75 Kg of anatase type titanium white pigment (Unitane 0-310, manufactured by Kemira Inc.) having a particle size of 0.2–0.3 μm was slowly introduced. Mixing was continued for 45 minutes after which an additional 11.43 Kgs of water were added and mixed for 15 minutes. The so-prepared premix was then dispersed using one pass through a 4-liter Netzsch media mill containing a 90% zirconium/silica media load under conditions of 80° F. temperature, 2300 rpm shaft speed and 0.669 liter/minute flow rate.

PREPARATION OF HYDROPHILIC COLLOID COATING COMPOSITION

Ingredients (1) through (5) in the amounts specified in Table I were added together in the order indicated in Table I. Conventional paddle stirrer mixing was used during each component addition with a 5 minute mix interval between additions. The 10% gelatin (component 6) was melted separately at 104° F. and pH adjusted to 8–9 using 2N NaOH. The mixture of components (1) through (5) were thereafter added to the gelatin with continued slow stirring for 30–45 minutes after addition was complete. pH of the final composition was then lowered to 5.0 using 1.6 N HN03.

The hydrophilic colloid coating composition was then coated simultaneously as the bottom layer with the seven gelatin layers described below on the corona-discharge treated $TiO_2$/brightened polyolefin surface of the above described support, various components being deposited in the following coverage to provide a light sensitive photographic material.

The seven gelatin layers are as follows, layer 1 being adjacent to the hydrophilic colloid layer:

Layer 1—Blue Sensitive Layer

Chemically and blue spectrally sensitized monodisperse silver chloride negative emulsion (0.34 g Ag/m$^2$) and yellow-dye forming coupler Y (1.08 g/m$^2$) in di-n-butyl phthalate coupler solvent (0.27 g/m$^2$), gelatin (1.51 g/m$^2$)

Layer 2—Interlayer

Gelatin (0.75 g/m$^2$)

0.84 g/m$^2$ 1,4-dihydroxybenzene (oxidized developer scavenger)

Layer 3—Green Sensitive Layer

Chemically and green spectrally sensitized monodisperse silver chloride negative emulsion (0.33 g Ag/m$^2$) and magenta-dye forming coupler M (0.42 g/m$^2$) in di-n-butyl phthalate coupler solvent (0.22 g/m$^2$), gelatin 1.2 g/m$^2$)

Layer 4—UV Absorbing Interlayer

A mixture of hydroxyphenylbenzotriazoles (0.38 g/m$^2$), gelatin (0.76 g/m$^2$)

Layer 5—Red Sensitive Layer

Chemically and red spectrally sensitized monodisperse silver chloride negative emulsion (0.31 g Ag/m$^2$) and cyan-dye forming coupler C (0.42 g/m$^2$) in di-n-butyl phthalate coupler solvent (0.24 g/m$^2$), gelatin (1.08 g/m$^2$)

Layer 6—UV Absorbing Layer

A mixture of hydroxyphenylbenzotriazoles (0.38 g/m$^2$), gelatin (0.76 g/m$^2$)

Layer 7—Overcoat Layer

Gelatin (1.35 g/m$^2$)

The layers 1 to 6 were hardened with bis(vinylsulfonyl)methyl ether at 1.8% of the total gelatin weight. Coupler identifications are:

C=Cyan dye forming coupler: 2-(α-(2,4 di-tert-ampyl-phenoxy)butyramido)-4,6-dichloro-5-ethyl phenol M=Magenta dye forming coupler: 1-(2,4,6-trichlorophenyl)-3-(2-chloro-5(a-(4- hydroxy 3-tert-butylphenoxy)-tetradecanoamido)anilino)-5-pyrazolone Y=Yellow dye forming coupler: α-(4-(4-benzyloxyphenyl-sulfonyl)phenoxy)-o-(pivalyl)-2-chloro-5-(γ-(2,4-di-t-amylphenoxy)butyramido)acetanilide This sample, together with a control sample 1 being exactly the same, with the exception that it does not have a hydrophilic colloid layer was exposed stepwise to blue, green, and red light and then developed in a three-step process of color development (45 seconds at 95° F.), bleach-fix (45 seconds at 95° F.), and washing (90 seconds at 91°–94° F.), followed by drying (60 seconds) at 60° C.

The formulations for the above processing solutions are as follows:

| | |
|---|---|
| (1) Color developer: | |
| Lithium salt of sulfonated polystyrene (30% by wt) | 0.23 g |
| Triethanolamine | 8.69 g |
| N,N-diethylhydroxylamine (85% by wt) | 5.04 g |
| Potassium sulfite | 0.24 g |
| Color developing agent 4-(N-ethyl-N-2-methanesulfonylaminoethyl)-2-methylphenylenediaminesesquisulfate monohydrate | 5.17 g |
| Blankophor REU, 133% | 2.1 g |
| Lithium sulfate | 1.83 g |
| Potassium chloride | 1.6 g |
| Potassium bromide | 10 mg |
| 1-hydroxyethyl-1,1-diphosphonic acid | 0.81 g |
| Potassium bicarbonate | 3.59 g |
| Potassium carbonate | 20.0 g |
| Water to total of 1 liter, pH adjusted at 80° F. to 9.98. | |
| (2) Bleach-fix: | |
| Ammonium thiosulfate | 127.4 g |
| Sodium metabisulfite | 10 g |
| Ethylenediaminetetraacetic acid ferric ammonium salt | 110.4 g |

-continued

| | |
|---|---|
| Glacial Acetic acid | 10.2 g |
| Water to total 1 liter, pH adjusted at 80° F. to 5.5. | |

EXAMPLE 3 (Control)

Example 3 corresponds to Example 2 except that in place of the hydrophilic colloid layer, an antihalation layer of 0.88 g/m$^2$ colloidal silver and 1.54 g/m$^2$ of gelatin is utilized between the emulsion layers and the paper support.

EXAMPLE 4 (Control)

Example 4 corresponds to Example 2 except that after the hydrophilic colloid layer is formed, an antihalation layer is then layed down that comprises 0.88 g/m$^2$ colloidal silver and 0.91 g/m$^2$ of gelatin.

EXAMPLE 5 (Invention)

Example 5 corresponds to Example 2 except that the hydrophilic colloid layer is combined with antihalation material to form a layer having the following composition at laydown.

| | |
|---|---|
| 1.08 g/m$^2$ | Gelatin |
| 3.95 g/m$^2$ | $TiO_2$ |
| 1.97 g/m$^2$ | Ropaque (give composition) |
| 0.86 g/m$^2$ | OB (give composition) |
| 0.005 g/m$^2$ | Tint (give composition) |
| 0.88 g/m$^2$ | Colloidal silver |

Samples 1–5 were developed and the density measured. The results are set forth in Table II wherein Samples 1–4 are control examples. Modular transfer function (MT), described in chapter 23 of the Photographic Process Third Edition, Edited by the MacMillan Company is used as a measure of printing image sharpness. The larger the value of the MT function, the better is the sharpness. Table II below illustrates the advantage in sharpness by Modular Transfer Function measurement improvement that is achieved with the invention. The Modular Transfer Function column of Table II clearly indicates that the invention examples 4 and 5 provide a significantly improved Modular Transfer Function and, therefore, a noticeable increase in sharpness. The sharpness is superior to that achieved by use of the hydrophilic colloid layer alone or the antihalation layer alone. The improvement in sharpness without loss of speed by the combination of these materials is unexpected. Illustrated below are representations of the layer structures of each of Examples 1–5.

| | |
|---|---|
| Example 1 (Control) | Example 1 |
| | emulsion |
| | paper support |
| Example 2 (Control) | Example 2 |
| | emulsion |
| | hydrophilic colloid |
| | paper support |
| Example 3 (Control) | Example 3 |
| Colloidal Silver 0.88 g/m$^2$ and 1.54 g/ft$^2$ gelatin in antihalation layer | emulsion |
| | antihalation |
| | paper support |
| Example 4 (Control) | Example 4 |
| Two layer structure | emulsion |
| Antihalation material: | antihalation |
| Colloidal Silver 8 mg/ft$^2$ AG, 82.5 mg/ft$^2$ gelatin) | hydrophilic colloid |
| | paper support |

-continued

| | | |
|---|---|---|
| Example 5 (Invention) | | Example 5 |
| Single layer structure | | emulsion |
| Antihalation and hydrophilic colloid | | antihalation and hydrophilic colloid |
| 100 mg/ft$^2$ | gelatin | paper support |
| 367 | $TiO_2$ | |
| 183 | Ropaque | |
| 80 | BOB | |
| .05 | Tint | |
| 8 | Colloidal Silver | |

TABLE II

| Example | Speed Red | Speed Green | Speed Blue | Modular Transfer Function 10 cycle/mm |
|---|---|---|---|---|
| 1 Control | 175 | 173 | 158 | 30.0 |
| 2 Control | 177 | 172 | 162 | 50.2 |
| 3 Control | 163 | 165 | 137 | 40.1 |
| 4 Control | 162 | 162 | 133 | 54.5 |
| 5 Invention | 171 | 168 | 152 | 51.6 |

The invention has been described in detail with particular reference to preferred embodiments thereof, but it will be understood that variations and modifications can be effected within the spirit and scope of the invention.

We claim:

1. A photographic element comprising a paper substrate with a polyolefin coating provided on at least one surface, a hydrophilic colloid layer on the polyolefin coating, and at least one light sensitive silver halide emulsion above the hydrophilic colloid layer, wherein said hydrophilic colloid layer comprises a removable antihalation material and from about 20 to 80 percent by weight of a white pigment, and from about 5 to 35 percent by weight of hollow microspheres having a diameter of from about 0.1 to about 1 micrometer.

2. The photographic element of claim 1 wherein the hydrophilic colloid layer contains an optical brightener.

3. The photographic element of claim 1 wherein the white pigment is $TiO_2$.

4. The photographic element of claim 1 wherein the white pigment is anatase $TiO_2$.

5. The photographic element of claim 1 wherein the white pigment is rutile $TiO_2$.

6. The photographic element of claim 1 wherein the hydrophilic colloid is present in the amount of from about 5 to about 50 percent by weight.

7. The photographic element of claim 1 wherein the hydrophilic colloid is present in the amount of from about 8 to about 35 percent by weight.

8. The photographic element of claim 1 wherein the hydrophilic colloids is present in the amount of from about 10 to about 25 percent by weight.

9. The photographic element of claim 1 wherein the hydrophilic colloid layer gelatin.

10. The photographic element of claim 2 wherein the optical brightener is loaded on a latex polymer.

11. The photographic element of claim 1 wherein the hydrophilic colloid layer is coated at a coverage of at least about 5.4 g/m$^2$.

12. The photographic element of claim 1 wherein the hydrophilic colloid layer is coated at a coverage from about 5.4 g/m$^2$ to about 16.2 g/m$^2$.

13. The photographic element of claim 1 wherein the hydrophilic colloid layer is coated at a coverage from about 7.5 g/m$^2$ to about 10.9 g/m$^2$.

14. The photographic element of claim 1 wherein said antihalation material comprises colloidal silver.

15. The photographic element of claim 1 wherein said antihalation material comprises a filter dye.

* * * * *

UNITED STATES PATENT AND TRADEMARK OFFICE

CERTIFICATE OF CORRECTION

PATENT NO. : 5,252,424

DATED : Oct. 12, 1993

INVENTOR(S) : Erika M. Sato, et al

It is certified that error appears in the above-indentified patent and that said Letters Patent is hereby corrected as shown below:

In Column 12, line 53, delete "layer" and insert --is--.

Signed and Sealed this

Twenty-second Day of March, 1994

*Attest:*

Bruce Lehman

BRUCE LEHMAN

*Attesting Officer*

*Commissioner of Patents and Trademarks*